US005617751A

United States Patent [19]

Song

[11] Patent Number: 5,617,751

[45] Date of Patent: Apr. 8, 1997

[54] KEY FOB AND ATTACHMENT

[76] Inventor: Chang J. Song, 6740 Comstock Road, Richmond, Canada, V7C 2X6

[21] Appl. No.: 621,306

[22] Filed: Mar. 22, 1996

Related U.S. Application Data

[60] Division of Ser. No. 196,534, Feb. 14, 1994, Pat. No. 5,501,089, which is a continuation-in-part of Ser. No. 49,046, Apr. 16, 1993, Pat. No. 5,528,916.

[51] Int. Cl.[6] ..... A44B 15/00

[52] U.S. Cl. ..... 70/456 R; 40/634; 63/21; 206/37.1; 206/38.1

[58] Field of Search ..... 70/456 R, 457, 70/459, 460; 40/634, 734; 206/37, 37.1, 38, 38.1; 24/3.6; 63/2, 21, 23

[56] References Cited

U.S. PATENT DOCUMENTS

| | | | |
|---|---|---|---|
| 276,826 | 5/1883 | Jopson | 70/459 |
| 293,693 | 2/1884 | West | 70/459 |
| 395,515 | 1/1889 | Robertson | 206/37 R |
| 1,410,598 | 3/1922 | Reeves | 40/734 X |
| 1,438,839 | 12/1922 | Levey | 70/460 |
| 1,626,987 | 5/1927 | Venegas | 70/459 |
| 2,252,487 | 8/1941 | Bevill | 40/634 X |
| 2,307,808 | 1/1943 | Segal | 70/459 |
| 2,503,211 | 4/1950 | Ormsbee . | |
| 2,596,374 | 5/1952 | Crapster | 70/456 R |
| 2,791,899 | 5/1957 | Marien | 70/459 |
| 3,362,201 | 1/1968 | Lachin | 70/459 |
| 3,589,155 | 6/1971 | Kamp | 70/459 |
| 3,670,524 | 6/1972 | Korwin | 63/23 X |
| 3,776,009 | 12/1973 | MacGlashan | 70/459 |
| 3,863,477 | 2/1975 | Klein | 70/456 R |
| 4,129,021 | 12/1978 | Brentini | 70/459 X |
| 4,220,016 | 9/1980 | Frenger | 63/2 |
| 4,224,364 | 9/1980 | Hunt | 40/734 X |
| 4,741,189 | 5/1988 | Battenberg | 70/456 R |
| 4,769,799 | 9/1988 | Matsukage | 206/38.1 X |
| 5,294,466 | 3/1994 | Baughman | 409/634 X |
| 5,501,089 | 3/1996 | Song | 70/456 R |
| 5,528,916 | 6/1996 | Song | 70/456 R X |

FOREIGN PATENT DOCUMENTS

| | | | |
|---|---|---|---|
| 1319982 | 1/1963 | France | 70/459 |
| 1420570 | 11/1965 | France . | |
| 1485644 | 5/1967 | France . | |
| 2258812 | 9/1975 | France . | |
| 2612056 | 9/1988 | France . | |
| 318207 | 1/1920 | Germany . | |
| 2856837 | 7/1980 | Germany . | |
| 445005 | 2/1949 | Italy . | |
| 344178 | 3/1931 | United Kingdom . | |
| 913494 | 12/1962 | United Kingdom . | |
| 1019143 | 2/1966 | United Kingdom . | |
| 1235072 | 6/1971 | United Kingdom . | |

*Primary Examiner*—Lloyd A. Gall

*Attorney, Agent, or Firm*—Townsend and Townsend and Crew LLP

[57] ABSTRACT

A key fob includes at least one dome with a display surface and a flange secured in a fob. The fob is sewn in a pattern around or through the flange or openings therethrough. The fob may also be formed by placing display domes within an outer rim and sealing the combination within a u-shaped ring. Designs and slogans may be placed on the display surfaces. The fob may then be attached to a key ring using a clip configured to accommodate crimping. The clip attachment allows the fob to rotate freely around the key ring.

17 Claims, 3 Drawing Sheets

KEY FOB AND ATTACHMENT

This application is a division of Ser. No. 08/196,534, filed Feb. 14, 1994, now U.S. Pat. No. 5,501,089, which is a continuation-in-part of Ser. No. 08/049,046, filed Apr. 16, 1993, now U.S. Pat. No. 5,528,916.

BACKGROUND OF THE INVENTION

There is a continuing interest in providing devices which enable a person to easily locate important, yet easily lost or misplaced items such as keys. There is also a continuing interest in providing novelty items which may be selected to reflect individual tastes or to meet a specific advertising need.

Both of these continuing needs have been satisfied by the use of key fobs. Key fobs are articles which attach to items such as key rings to help the owner more easily locate the item. Key fobs have also been found to be useful for displaying novelty or commercial slogans, logos, or the like.

A variety of key fobs are presently in existence. For example, one common key fob uses a belt to attach a display dome to a fob. Unfortunately, this type of key fob allows the dome to flap away from the fob. This can result in unnecessary bulk which is difficult to place in a confined place such as a pocket. The flapping may also be an annoyance to the user, and results in unnecessary wear on the key fob allowing the dome to part from the fob prematurely. Manufacturing is complicated by the need to perform the additional folding and sewing. Thus, there is a continuing need for providing a key fob which is easily customized and which is easily manufactured and assembled.

There has also been a continuing need for a reliable means for attaching the key fob to a key ring or key chain. Prior art devices permanently attached the key fob to the key ring, and required the use of integrally shaped attachment devices. This precluded the ability to easily and interchangeably attach a variety of key fobs.

SUMMARY OF THE INVENTION

The present invention relates to the construction of a key fob for attachment to a key ring or the like, as well as a means for reliably attaching the key fob to a key ring.

According to one embodiment the key fob has a dome with a display surface secured to the fob. The dome has a flange which is inserted beneath the top layer of the fob. The dome is then sewn into the fob by placing stitches through the fob material around the exterior of the flange. This reliably secures the dome onto the fob in a single sewing step.

According to another embodiment the dome has a flange which includes a plurality of prongs which radiate from the flange. Again, the dome is attached to the fob by sewing around the exterior of the flange.

According to another embodiment the dome has a flange which includes a plurality of recesses disposed around the circumference of the flange. The dome is attached to the fob by sewing the fob in those areas where the flange is recessed.

Yet another embodiment utilizes a pliable material for the flange. Again, the fob is sewn, and in this embodiment, the stitching passes through the pliable flange material.

According to another embodiment, the key fob has two thin display inserts placed between two transparent display domes, all of which are seated in a rim. The thin display inserts may be easily replaced and may exhibit pictures, novelty marks, advertising slogans, or the like through the transparent display domes. The pieces are secured together within the rim by a U-shaped ring which fits over the rim assembly. The pieces may be prevented from rotating within the rim by including a notch in each of the pieces and corresponding dimples on the rim. Fabrication is thus simplified while allowing an easily customized fob, which, in some embodiments, may be customized by the individual user.

According to another embodiment, the key fob has one thin display insert displayed through a transparent display dome. The thin display insert is sandwiched between the transparent display dome and an opaque dome. The opaque dome has an outward-facing surface which is flat and which has an annular ridge enclosing an area on the surface of the opaque dome. A clear or opaque display insert may be placed within the area formed by the annular ridge. Again, the pieces of the key fob are secured together by a U-shaped ring. Other embodiments may include any combination of opaque domes and clear domes. The result is an easily fabricated key fob structure which allows customization of the fobs.

According to another embodiment of the present invention, an improved means for attaching a key fob to a key ring or key chain is disclosed. The key fob includes a device such as a t-member which has barrel-shaped shoulders which fit into a end hole of an attaching device connected to the key ring. Guide holes allow the insertion of a specially-made clip between the shoulders. The result is a means for easily attaching a key fob to a key ring which allows a full range of movement of the key fob as well as easy replacement of the fob.

DESCRIPTION OF THE PREFERRED EMBODIMENT

Figure 1A:
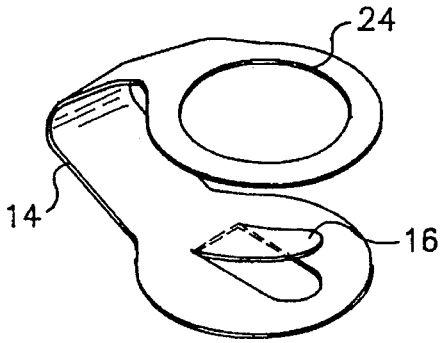
FIG. 1A PRIOR ART
FIG. 1A is a view of a prior art key fob before a dome is installed.
Figure 1B:
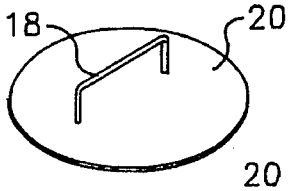
FIG. 1B PRIOR ART
FIG. 1B is a back view of a prior art dome for installation in the fob of FIG. 1A.

Referring now to FIGS. 1A and 1B, a prior art key fob is shown. A fob 14 is shown which includes a belt 16 for accommodating a dome 20. The dome 20 is installed into the fob 14 by threading the belt 16 through a loop 18 which is affixed to the underside of the dome 20. The belt 16 is secured to the dome 20 by use of glue, thread, or the like. The fob is then sewn together by stitching around the exterior edges of the fob. The resulting key fob has a dome which can move or flap because it is attached to the fob by the belt. The flapping can be annoying to the user, and may result in premature breakage of the key fob, as the attachment of the belt to the dome is subject to greater wear. Further, use of the belt and loop complicates manufacture of the key fob as sewing and folding of the belt results in an extra manufacturing step which often requires manual attention. Additionally, forming a dome with a loop 18 results in additional expense and extra thickness for the dome structure.

Figure 2A:
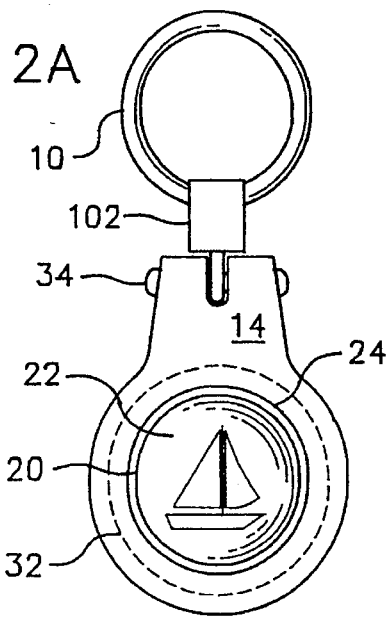
FIG. 2A is a top view of a key fob and key ring according to one embodiment of the present invention.

Referring now to FIG. 2A, a key fob according to the present invention is shown. The key fob includes a fob 14, a dome 20 having a display surface 22 and a flange 26. The dome 20 is fixed to the fob 14 such that it does not flap away from the surface of the fob. Thus,.the entire key fob can be carried easily in a compact space such as a pocket without undesired bulk or flapping. The display surface 22 may be used to exhibit advertising or novelty wording or characters. The key fob may be easily and economically assembled. Throughout the drawings, a key ring is shown. However, the invention is not limited to key rings and is applicable to any device in which a ring is used as a retaining/securing element. Similarly the ring need not be circular. Assembly of the key fob will now be discussed in detail.

Figure 2B:
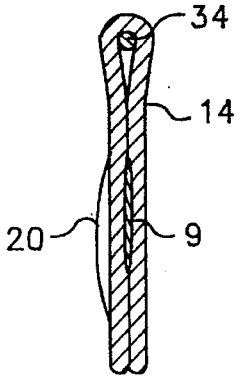
FIG. 2B is a side view of the key fob of FIG. 2A.

According to one embodiment of the present invention, the fob 14 consists of a single piece of material such as leather, plastic, denim, or the like with a cut-out 24 matching the size and shape of the dome 20 (although the cut-out may depart slightly from the dome size and shape, e.g., to provide clearance for ease of assembly). As shown in FIG. 2B, the single piece is folded over a t-member 34. In the embodiment shown, the dome 20 is limited to a single side of the fob 14. However, in alternative embodiments, a two-sided dome, or a dome placed on each side of the fob 14 may be used. The dome 20 may be constructed of a variety of materials including, but not limited to metal, wood, plastic or any combination of such materials. While the dome 20 is shown as being circular, it may be any shape, including oval, square, triangular, or the like. The fob 14 and the cutout 24 may be modified accordingly to accommodate the shape of the dome 20.

Figure 3A:
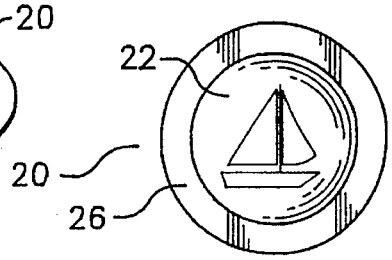
FIG. 3A is a top view of a dome according to one embodiment of the present invention.
Figure 3B:
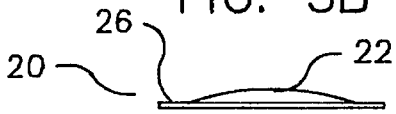
FIG. 3B is a side view of the dome of FIG. 3A.

The dome 20 includes a flange 26. This is shown in more detail in FIGS. 3A and 3B. According to one embodiment, the flange 26 is evenly spaced about the circumference of the dome. The dome is installed into the fob 14 by placing the flange 26 under the upper surface of the fob 14. The fob has a cut-out 24 the size and shape of the dome 20. The flange 26, which has a larger diameter than the dome 20, is placed underneath the fob 14 and is hidden from view after installation. The dome is secured by stitching around the circumference of the flange 26. According to one embodiment, shown in FIG. 2, the stitching is placed just outside of the outer circumference of the flange 26. This results in a flap of fob material which overlies the flange 26 which is sufficient to secure the dome 20 within the fob 14 without flapping or unnecessary wear. Construction is simplified as there is no belt to install, thereby avoiding additional folding and sewing. In the alternative, glue 9 may be used to secure the flange.

Figure 4A:
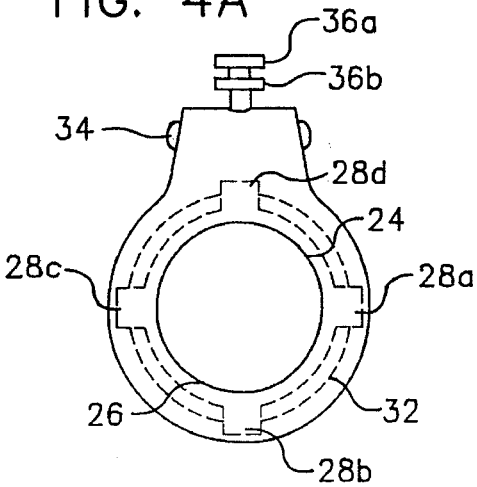
FIG. 4A is a top view of a key fob according to one embodiment of the present invention.

According to another embodiment, shown in FIG. 4A, the dome 20 is constructed with a flange 26 which contains several prongs 28*a–d* which radiate outward from the dome. The dome 20 is secured into the fob 14 by placing stitches 32 around the outer circumference of the flange 26, but not through the prongs 28*a–d*. The dome 20 is secured by a flap of fob material and by the force of thread securing the prongs.

Figure 4B:
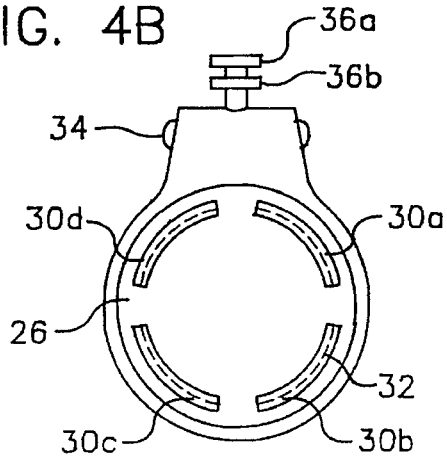
FIG. 4B is a top cut-away view of a key fob according to one embodiment of the present invention.

According to another embodiment, shown in FIG. 4B, the dome 20 is constructed with a flange 26 which contains several openings, e.g., 30*a–d* disposed around the exterior of the flange. Again, the dome is secured to the fob 14 by stitches 32. The stitches 32 are placed through the fob and through the openings 30*a–d*.

According to another embodiment the dome 20 is constructed with a flange 26 which is made of a pliable material, such as plastic, which will permit the receipt of stitches. The stitches 32 are placed through the fob material and through the flange 26, resulting in a strong and secure attachment.

Figure 5A:
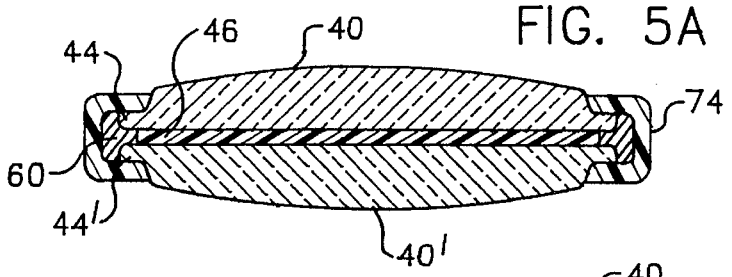
FIG. 5A is a longitudinal cross-section of a key fob according to one embodiment of the present invention.
Figure 6A:
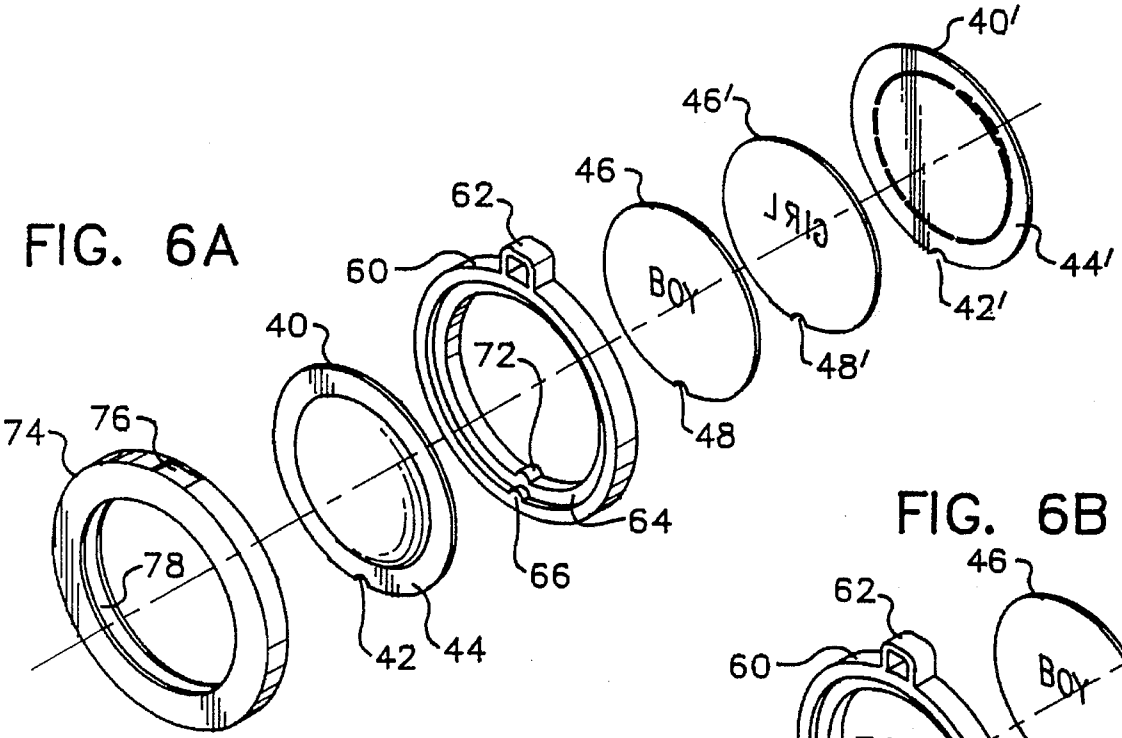
FIG. 6A is an exploded perspective view of the key fob of FIG. 5A.

Referring now to FIGS. 5A and 6A, another embodiment of a key fob is shown. This embodiment allows simple fabrication of a key fob with a display surface on both sides of the fob. In this embodiment, the fob has two clear domes 40 and 40'. The domes may be round, and include a flange 44, 44' around the exterior of the dome. The top of the dome may have a slight convex shape while the rear of the dome is flat. Each dome may have an indent 42. The domes 40 may be made of hard plastic, glass, or any other suitable transparent material. The domes are sized such that they fit within the inner cup 64 of the rim 60.

An insert 46, 46' is placed behind each clear dome 40, 40'. Each of these inserts 46, 46' may have a picture, novelty marking, advertising slogan, or the like placed on it. Each of the inserts may have an indent 48, 48'. The inserts may be made of plastic, cardboard, metal, or any other suitable material. Alternatively, a single insert may be placed between the domes.

The embodiment of a key fob shown in FIGS. 5A and 6A also includes a rim 60 into which the clear domes 40, 40' and inserts 46, 46' are placed. The rim has two inner cups 64 which hold the clear domes 40, 40'. The rim may have several dimples 66, 72 which mate with the indents 42, 48 on the clear domes and on the inserts to prevent rotation of the domes and inserts. The rim also includes a loop 62 which allows attachment to a closing device 102 or directly to a key ring 10. The rim 60 may be made of hard plastic, rubber, metal or any other suitable material.

The embodiment of FIGS. 5A and 6A also includes a ring 74 with a U-shaped cross-section which fits around the rim 60 and securely holds the clear domes and inserts within the rim. The U-shaped ring 74 is further provided with a cut-out hole 76 through which the loop 62 may project. As shown in FIG. 5A, the arms of the U-shaped ring 74 extend far enough to hold the flanges 44, 44' of each of the domes 40, 40' securely within the rim 60. The U-shaped ring 74 may be made of plastic, rubber or any other suitable material.

Figure 5B:
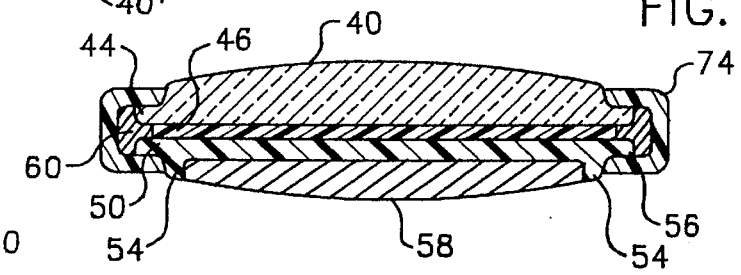
FIG. 5B is a longitudinal cross-section of a key fob according to one embodiment of the present invention.
Figure 6B:
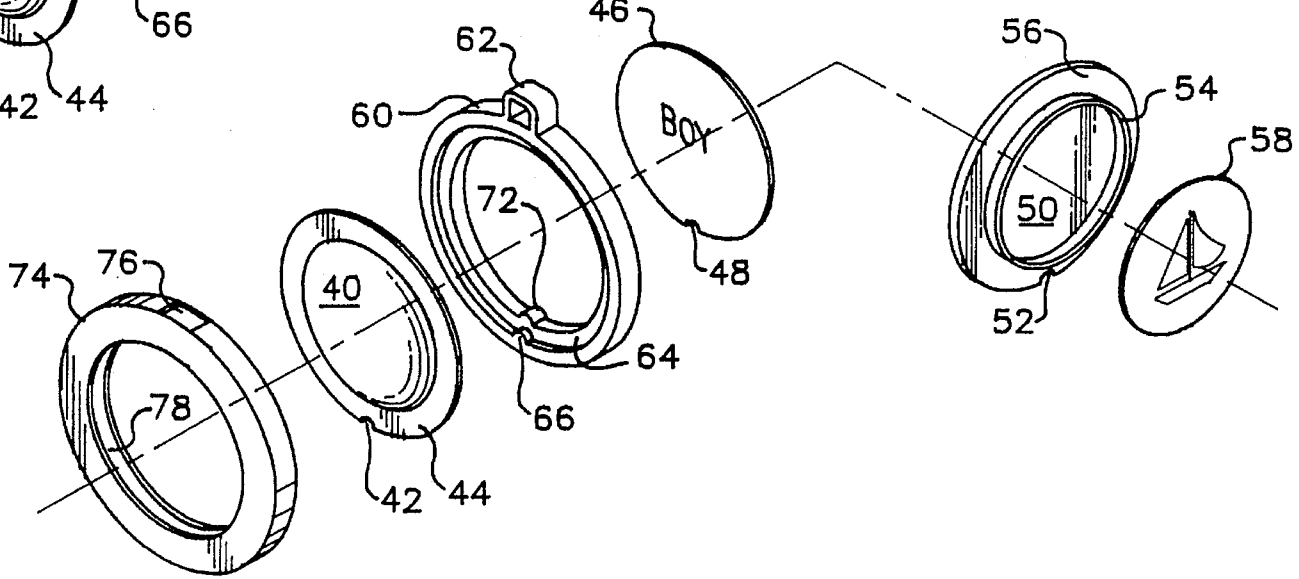
FIG. 6B is an exploded perspective view of the key fob of FIG. 5B.

Referring to FIGS. 5B and 6B another embodiment of a key fob is shown. In this embodiment, the fob comprises a single clear dome 40 and an opaque dome 50 with a plastic display insert 58. The construction of the clear dome 40 is similar to that discussed above. The opaque dome 50 has a flat outer surface and includes an outer flange 56 and an annular ridge 54 which defines an area on the surface of the opaque dome. A display insert 58 is placed into the area defined by the annular ridge. The display insert 58 may include indicia, pictures, or other novelty markings. The display insert 58 may be secured to the opaque dome 50 through use of glue, epoxy, press fitting, or other means well-known in the art. The opaque dome 50 may be constructed of hard plastic, rubber, metal or any other suitable material. The opaque dome 50 may also include an indent 52 which mates with a dimple 66 on the rim 60 to prevent rotation of the dome within the rim.

Construction of the key fob according to the embodiment shown in FIGS. 5B and 6B is similar to that as discussed above. The opaque dome 50 is placed within the inner cup 64 of the rim 60 as is the clear dome 40 and insert 46. The dimples 66, 72 prevent rotation of the devices. The U-shaped ring 74 is placed around the rim 60 to securely enclose the domes 40, 50 and insert 46.

In another embodiment, two opaque domes 50 may be used instead of the clear domes 40. In yet another embodiment, the domes may be further secured through the use of glue, cement or epoxy.

Referring again to FIG. 2B, a fob 14 is shown attached to a t-member 34. Preferably, the fob is attached to the t-member by folding two halves of the fob around the member to form a loop, as shown. This allows the fob 14 to swing along the t-member 34 such that the fob may fold flat against the key ring 10 thus taking up less space. The fob may also be glued, sewn, or attached to the t-member by other means well-known in the art. Referring to FIG. 2A, the t-member 34 is shown connected to a closing device 102 which in turn is connected to a key ring 10. Other means for securing the key fob to a ring may also be used. The closing device 42 will now be discussed in further detail.

Figure 7:
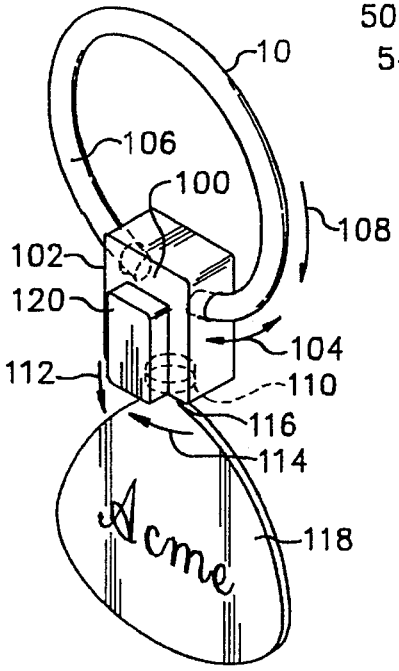
FIG. 7 is a perspective view of a ring securing device according to an embodiment of the present invention.

Referring now to FIG. 7A, one embodiment of a ring securing device is shown. The device of FIG. 7A includes a ring securing element or key ring 10. Key ring 10 does not form a closed ring, but instead includes a gap 100. During normal use, gap 100 is closed by a closing device 102 to prevent the items retained on the ring from slipping off the ring.

Closing device 102 is pivotally connected to ring 10 such that during normal use, device 102 can pivot through an arc 104 about a centerline axis 106 of ring 10. Thus, the entire mechanism can be carried easily in a compact space such as a pocket without undesired bulk. When closed, device 102 cannot, however, normally move around the circumference of ring 10 in the direction shown by arrow 108.

To add or remove keys from ring 10, a button tab 120 is pushed in the direction of arrow 112. The button 110 may rotate about the vertical axis in the direction of arrow 114. The device is thus less rigid and is better able to be folded or maneuvered into a confined space. Button 110 may optionally include a loop 116 for attaching a tag, an insignia, additional key ring or other secondary device 118. Alternatively, a key fob such as shown in FIGS. 2A, 6A or 6B may also be attached to the button. Depressing button tab 120 releases closing device 102 so that it is permitted to slide around the circumference of ring 10. This action exposes gap 100 so keys can be added or removed from ring 10. When device 102 returns to the closed position, the locking mechanism, automatically snaps back into place to retain device 102 in the closed, or locked, position.

Figure 8A:
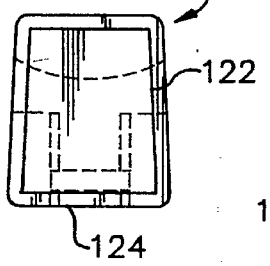
FIG. 8A is a front view of a closing device for the ring of FIG. 7.

FIGS. 8A–8G are drawings showing the component pieces of the closing device in greater detail. FIG. 8A is a front view of device 102. Device 102 may be fabricated from two cast pieces joined together by one or more rivets. Optionally, device 102 may be formed from a single cast piece. Device 102 includes a guide tube 122 through which ring passes. Tube 122 allows ring 10 to freely pass through the device 102 without the edges of ring 10 near gap 100 getting caught or hung up. Tube 122 therefore serves as a guide for ring 10 and insures ease of operation.

Figure 8B:
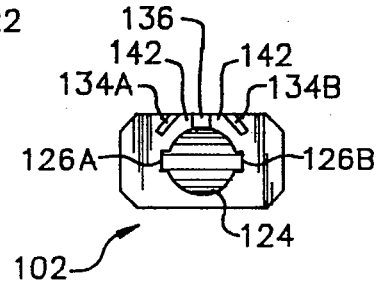
FIG. 8B is an end view of the closing device of FIG. 8A.
Figure 8C:
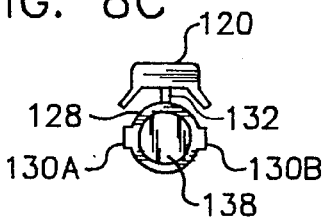
FIG. 8C is an end view of a stop mechanism contained within the closing device of FIGS. 8A and 8B.
Figure 8D:
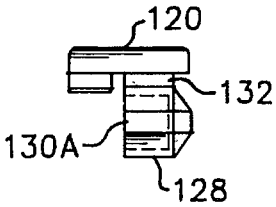
FIG. 8D is a side view of the stop mechanism of FIG. 8C.
Figure 8E:
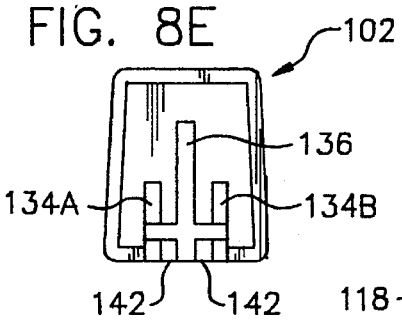
FIG. 8E is a top view of the closing device of FIGS. 8A and 8B.

Intersecting with guide tube 122 is an end hole 124. FIG. 8B is an end view of device 102 showing the details of end hole 124. Two guide slots 126A and 126B are located adjacent end hole 124. A stop 128 fits into passageway 124 and is guided along by projections 130A and 130B which mate with slots 126A and 126B of device 102. A button tab 120 attaches to stop 128 via a spar 132. A side view of the component of FIG. 8C is shown in FIG. 8D. The button tab 120 mates with recesses 134A and 134B of device 102 shown in FIG. 8B. Spar 132 is located in region 136 of FIG. 8B. FIG. 8E is a top view of device 102 showing the locations of the guide slots for the assembly of FIG. 8C.

Figure 8F:
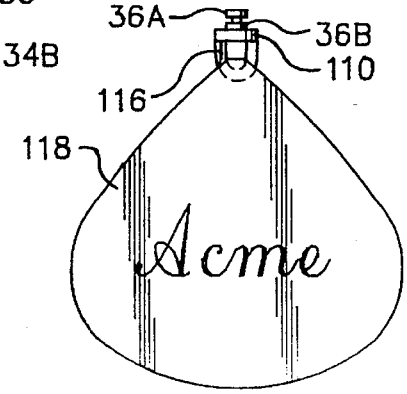
FIG. 8F is a front view of an embodiment of the shoulders for insertion into the closing device of FIGS. 8A and 8B.

As shown in FIG. 8C, stop 128 contains a receptacle 138 for receiving the end piece that contains button 110. FIG. 8F shows the construction of the end piece in detail. The end piece includes shoulders 36A, 36B for insertion into the closing device. FIG. 8F shows the construction of an optional piece 118 for use as an end piece for a key fob according to the present invention. The optional part 118 includes shoulders 36A, 36B for insertion into the closing device.

In operation, the assembly of FIG. 8C is mated with the end piece assembly of FIG. 8F. The resulting structure is inserted into device 102 such that stop 128 rests in ring gap 100 located at the intersection of end hole 124 and tube 122 of FIG. 8A. Projections 130A and 130B maintain stop 128 in position when the device is closed. Otherwise, ring 10 might slide on device 102 and open enough of a gap for a key to fall off the ring. The ring securing device is thus closed, and the closing mechanism cannot travel along the circumference of ring 10. To open the ring, the user depresses one of button tab 120 or button 110 to release the biasing force on stop 128. The stop assembly can then slide down end hole 124 and away from tube 122. Ring 10 can then freely pass through guide tube 122 until the gap is exposed.

The mechanism of FIGS. 8A–8G may be simply and economically assembled. The stop mechanism of FIG. 8C is simply inserted through the end hole followed by the end piece with optional part 118. The collar segments 142 can then be crimped to complete the assembly.

Figure 8G:
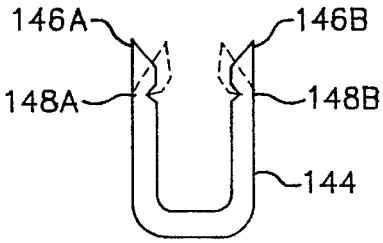
FIG. 8G is a top-view of a clip for use in the closing member of FIGS. 8A and 8B.

Referring now to FIGS. 8F, and 8G, another feature of the present invention is shown. The t-member 34 (e.g., FIG. 4A), to which the fob 14 is flexibly attached, includes a vertical member with two shoulders 38A and 38B which permit connection to the closing device 102. Similarly, the button 110 of FIG. 8F also has two shoulders 36A and 36B. The two shoulders slide into the end hole 124 of the closing device. A clip 144 is then inserted into recesses 134A and 134B. The clip 144 is constructed such that insertion is easily accommodated and, thereafter, the clip is held in place by crimping, e.g., with a simple crimping tool. The clip 144 has two tips 146A, 146B and two indents 148A and 148B to facilitate insertion by permitting the clip to flex as it is inserted past the t-member. Easy rotation of the t-member is permitted. After the clip is in place it is crimped to hold it in position. A jawed crimping tool may be used, if desired. The tips 146A, 146B are angled to accommodate crimping such as by allowing the jaws of a crimping tool to be positioned easily on the outside edges of the tips. The tips 146A, 146B are then moved towards one another, e.g., by compressing the Jaws of the crimping tool. The indents 148A, 148B form a weakened area of the clip 144 so that crimping causes the clip to be deformed to the configuration shown by phantom lines in FIG. 8G.

The closing device 102 is then connected to the key ring 10 through guide tube 122 to complete the key fob structure. The t-member 34 and the closing device 102 may be constructed of a variety of materials, including metal, using techniques well-known to those skilled in the art. The clip 144 is preferably constructed of a cast metal, although other materials and techniques may be used as is known in the art.

Other embodiments and modifications apparent to those skilled in the art may be used. For example, although a t-member 34 is disclosed here for use in attaching the fob 14 to the key ring 10, other methods of attaching may be used. The "button" shown in FIG. 8F may also be used in conjunction with the clip 144 disclosed herein. As another example, although the fobs of FIGS. 6A and 6B are shown to be round, other shapes of fobs, rims, inserts, and rings may be used as well.

Although the present invention has been described by way of a preferred embodiment and certain variations and modifications, other variations and modifications can also be used, the invention being defined by the following claims.

What is claimed is:

1. A key fob for attachment to a key ring comprising:

a rim having a first inner cup, and a second inner cup;

a first dome having a first outer surface, a rear surface, and a flange, said first dome placed within said first inner cup of said rim;

a second dome having a second outer surface, a second rear surface, and a flange, said second dome placed within said second inner cup of said rim; and a ring having a u-shaped cross-section disposed around said rim, wherein said first and second domes are secured within said rim by said ring.

2. The key fob of claim 1, said rim further including a loop and said ring having a cut-out wherein said loop projects from said cut-out.

3. The key fob of claim 1, wherein said first and second domes are transparent, the key fob further including:

a first display insert placed behind said first dome;

a second display insert placed behind said second dome.

4. The key fob of claim 3, wherein said rim further includes dimples, wherein said dimples prevent rotation of said first and second domes and said first and second display inserts.

5. The key fob of claim 1, wherein said first dome is transparent, said second dome is flat and opaque having an annular rim disposed on said outer surface, the key fob further comprising:

a first display insert placed behind said first dome;

a second display insert placed in the area formed by said annular rim on the outer surface of said second dome.

6. The key fob of claim 5, wherein said rim further includes dimples, wherein said dimples prevent rotation of said first and second domes and said first display insert.

7. The key fob of claim 1, wherein said first dome and second dome are flat and opaque having an annular rim disposed on each of said first and second outer surfaces, the key fob further comprising:

a first display insert placed in the area formed by said annular rim on the outer surface of said first dome;

a second display insert placed in the area formed by said annular rim on the outer surface of said second dome.

8. A key fob for attachment to a key ring comprising:

a first transparent dome having a first outer surface, a rear surface, and a flange;

a second dome having a second outer surface with an annular rim disposed on said second outer surface, a second rear surface, and a flange;

means for cupping said first dome and said second dome, wherein said first and second outer surfaces face outward from said means for cupping;

means for securing said first and second domes within said means for cupping; a first display insert placed behind said first dome; a second display insert placed in the area formed by said annular rim on the second outer surface of said second dome.

9. The key fob of claim 8, wherein said first and second domes are transparent, the key fob further including:

a first display insert placed behind said first dome;

a second display insert placed behind said second dome.

10. The key fob of claim 9, wherein said means for cupping further includes means for preventing rotation of said first and second domes and said first and second display inserts.

11. The key fob of claim 8, wherein said means for cupping further includes means for preventing rotation of said first and second domes and said first display insert.

12. A method for constructing a key fob for attachment to a key ring, the method comprising the steps of:

providing a first dome having a first display surface and a flange;

providing a second dome having a second display surface and a flange;

providing a rim having a first inner cup, and a second inner cup;

inserting said first dome into said first inner cup of said rim, and said second dome into said second inner cup of said rim;

providing a ring having a u-shape cross-section;

inserting said rim containing said first dome and said second dome into said ring, wherein said ring securely retains said rim and said first and second domes.

13. The method of claim 12 wherein said rim further includes a loop and said ring includes a cut-out, wherein said loop protrudes from said cut-out.

14. The method of claim 12, wherein said first and second domes are transparent, the method further including the steps of:

inserting, behind said first dome, a first display insert;

inserting, behind said second dome, a second display insert.

15. The method of claim 14, wherein said rim further includes dimples, said dimples for preventing rotation of said first and second domes and said first and second display inserts.

16. The method of claim 12, wherein said first dome is transparent, said second dome is flat and opaque having an annular rim, the method further comprising the steps of:

inserting, behind said first dome, a first display insert;

inserting, into the area formed by said annular rim of said second dome, a second display insert.

17. The method of claim 16, wherein said rim further includes dimples, said dimples for preventing rotation of said first and second domes and said first display insert.

* * * * *